US006874661B2

(12) United States Patent
Timmerman et al.

(10) Patent No.: US 6,874,661 B2
(45) Date of Patent: Apr. 5, 2005

(54) STABILIZING CAP FOR DUAL-COMPARTMENT ADHESIVE DISPENSING CARTRIDGE

(75) Inventors: Mark S. Timmerman, Elgin, IL (US); James E. Surjan, St. Charles, IL (US); Richard P. Babrowski, Oak Lawn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 200 days.

(21) Appl. No.: 10/402,633

(22) Filed: Mar. 28, 2003

(65) Prior Publication Data

US 2004/0188465 A1 Sep. 30, 2004

(51) Int. Cl.[7] ..... B67D 5/52; B65D 47/10

(52) U.S. Cl. ..... 222/135; 222/137; 222/145.1; 222/153.03; 222/153.07; 222/386; 222/541.6; 222/541.7; 222/541.9; 215/253

(58) Field of Search ..... 222/135, 137, 222/145.1, 145.5, 153.03, 153.05, 153.06, 153.07, 541.1, 541.5, 541.6, 541.7, 541.9, 386; 215/235, 250, 253

(56) References Cited

U.S. PATENT DOCUMENTS 3,828,980 A * 8/1974 Creighton et al. ..... 222/137
4,355,729 A * 10/1982 Maguire ..... 215/215
4,771,919 A 9/1988 Ernst
5,137,182 A * 8/1992 Keller ..... 222/153.1
5,152,432 A * 10/1992 De Laforcade ..... 222/145.1
5,676,280 A 10/1997 Robinson
6,412,660 B1 * 7/2002 Bouix et al. ..... 222/94
6,484,904 B1 11/2002 Horner et al.
2002/0170926 A1 11/2002 Horner et al.

* cited by examiner

*Primary Examiner*—Gene Mancene
*Assistant Examiner*—Patrixk Buechner
(74) *Attorney, Agent, or Firm*—Lisa M. Soltis; Mark W. Croll; Donald J. Breh

(57) ABSTRACT

A cap member for a dual-compartment adhesive dispensing cartridge comprises a pair of dependent plugs, the cap member is initially integrally secured upon an upper end portion of a dispensing outlet portion by frangible connections which are defined between the plugs and upper end portions of a pair of dispensing conduits that are defined within the dispensing outlet portion by a divider wall. In addition, an axially oriented web member extends upwardly from a central region of the dispensing outlet portion, and the cap member is integrally secured to the upper extremity of the web member by another frangible connection. In this manner, when the cap member is to be separated from the dispensing cartridge, the integral connection defined between the cap member and the web member effectively serves as a pivotal fulcrum about which the cap member can be pivoted.

20 Claims, 4 Drawing Sheets

Fig. 3 (PRIOR ART)
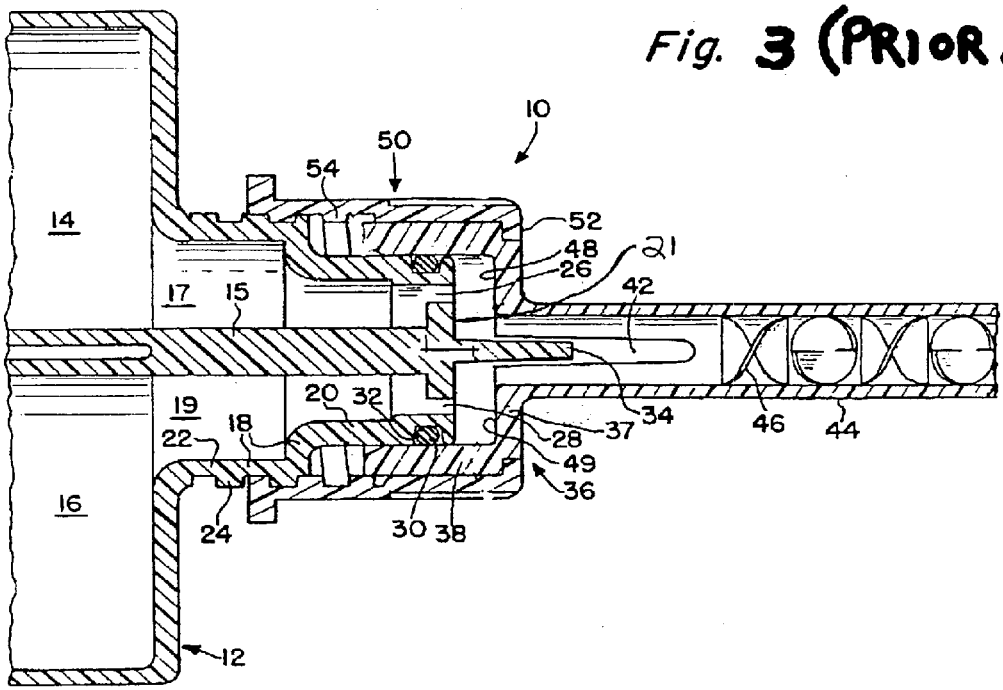
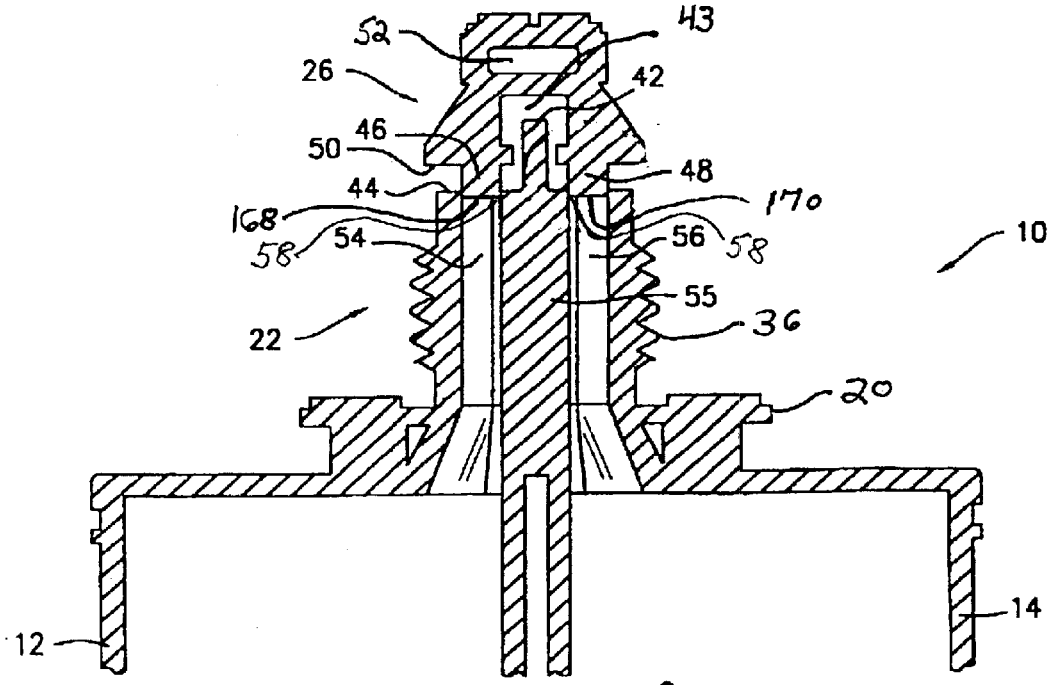
FIG. 4 (PRIOR ART)

FIGURE 5
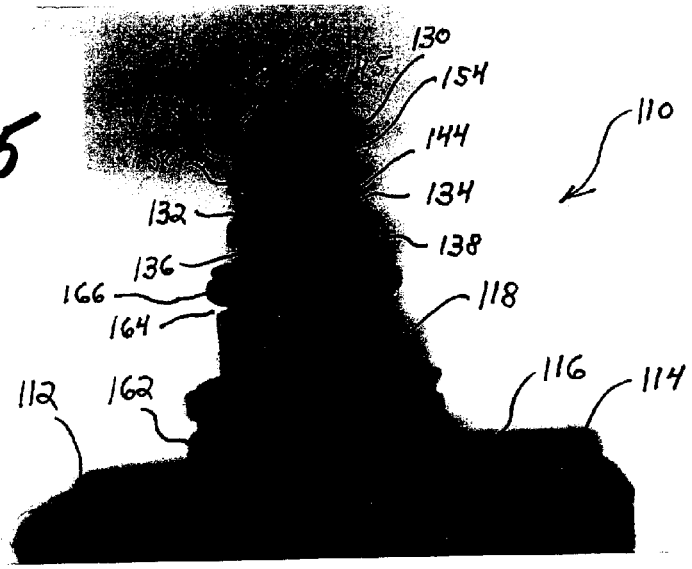
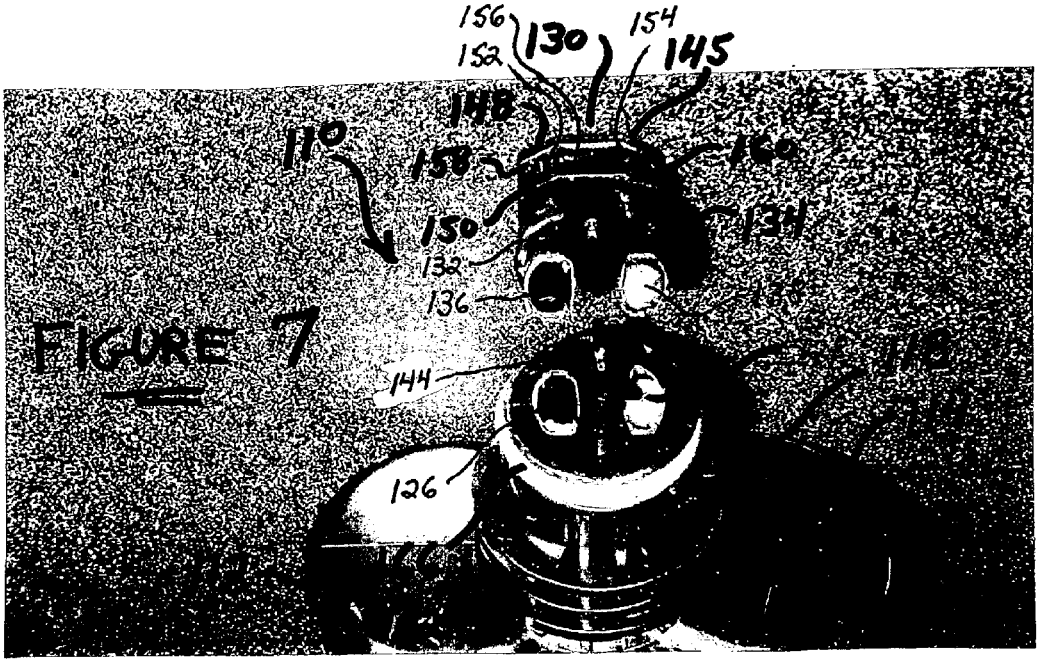
FIGURE 7

STABILIZING CAP FOR DUAL-COMPARTMENT ADHESIVE DISPENSING CARTRIDGE

FIELD OF THE INVENTION

The present invention relates generally to fluid dispensing cartridges, and more particularly to a new and improved dual-compartment adhesive dispensing cartridge which is provided with unique and novel structure for integrally attaching an external cap member to the output end of the dispensing port structure of the fluid dispensing cartridge, wherein such structure integrally attaching the external cap member to the output end of the dispensing port structure of the fluid dispensing cartridge effectively provides enhanced stabilization with respect to the mounting of the external cap member upon the fluid dispensing cartridge, wherein further, such structure integrally attaching the external cap member to the output end of the dispensing port structure of the fluid dispensing cartridge, and providing such enhanced stabilization of the cap member upon the output end of the dispensing port structure of the fluid dispensing cartridge, facilitates a relatively easy and well-defined separation of the external cap member from the output end of the dispensing port structure of the fluid dispensing cartridge, and wherein still further, such structure integrally attaching the external cap member to the output end of the dispensing port structure of the fluid dispensing cartridge, and facilitating the well-defined separation of the external cap member from the output end of the dispensing port structure of the fluid dispensing cartridge, serves to uncover and expose the dual-component dispensing ports of the fluid dispensing cartridge in a totally unobstructed manner whereby the dual components of the adhesive mixture can in fact be dispensed in accordance with the predeterminedly desired proportional amounts.

BACKGROUND OF THE INVENTION

Adhesive cartridges, conventionally utilized in connection with the performance of various bonding operations in conjunction with, or as part of, different maintenance or construction projects, usually comprise a pair of compartments wherein a first one of the two compartments is adapted to contain a resin constituent or component of the adhesive mixture, while a second one of the two compartments is adapted to contain an activator constituent or component of the adhesive mixture. The two compartments can be arranged with respect to each other either in a concentric mode or alternatively in a side-by-side mode. In addition, depending upon the particular application, that is, the particular environment, location, and intended use of the structures being bonded together, as well as, of course the particular resin and activator components or constituents to be utilized together, the volumes of the two compartments can either be equal, whereby equal volumes of the resin and activator components or constituents are adapted to be dispensed, or alternatively, the volume of, for example, the resin component or constituent compartment is substantially greater than that of the activator component or constituent whereby a proportionally greater amount of the resin component or constituent will be dispensed with respect to the amount of the activator component or constituent that is to be dispensed. A piston mechanism is disposed within the rear region of each compartment of the cartridge, and when a suitable plunger-rod mechanism, of a dispensing tool, is operatively engaged with a respective one of the piston mechanisms disposed within each one of the cartridge compartments, so as to accordingly move the piston mechanisms forwardly in the dispensing direction, each piston mechanism will, in turn, causes the particular adhesive mixture component or constituent disposed within its respective compartment to be moved forwardly toward a dispensing nozzle or mixing chamber from which the mixed adhesive components or constituents are in fact dispensed.

Examples of such aforenoted dual-compartment, two-component adhesive cartridges are of course well-known and are exemplified by means of the adhesive cartridges disclosed within U.S. Pat. No. 4,771,919 which issued to Ernst on Sep. 20, 1988, U.S. Pat. No. 5,676,280 which issued to Robinson on Oct. 14, 1997, and U.S. Pat. No. 6,484,904 which issued to Horner et al. on Nov. 26, 2002. As disclosed within FIGS. 1 and 2, which substantially correspond to FIGS. 1 and 2 of the aforenoted patent to Robinson, the dual-component cartridge dispenser is generally indicated by the reference character 10 and is seen to comprise a unitary cartridge body 12 which, in turn, comprises two substantially cylindrical hollow cartridges or vessels 14,16. The cartridges or vessels 14,16 are adapted to respectively contain a suitable liquid adhesive component, such as, for example, an epoxy resin component and a hardener component. The cartridge body 12 further comprises a pair of dispensing nozzles 20,22 which are respectively disposed in fluidic communication with the cartridges or vessels 14,16, and a cap 42 is integrally formed with, and frangibly connected to, the discharge end portions of the dispensing nozzles 20,22 by means of frangible seal portions 48,49. Receptacles 50,52 are defined within the cap 42, and plug members 58,60 respectively project into the receptacles 50,52 from a base portion 59 of the cap 42. When the cap 42 is removed from the dispensing nozzles 20,22, by means, or as a result, of a suitable twisting operation which effectively fractures or ruptures the frangible seal portions 48,49, dispensing ports, defined within the dispensing end portions of the dispensing nozzles 20,22, are accordingly uncovered so as to permit dispensing of the adhesive mixture components therefrom. When a particular adhesive dispensing operation is completed, the cap 42 is accordingly manipulated so as to insert the plug members 58,60 into the dispensing ports so as to effectively reseal the same such that additional dispensing of the adhesive mixture components can be performed at subsequent times.

A second conventional dual-component adhesive dispensing device is disclosed within FIG. 3, which substantially corresponds to FIG. 1 of the aforenoted Ernst patent, and is generally indicated by the reference character 10. More particularly, the adhesive dispensing device 10 comprises a body member 12 which includes first and second chambers or compartments 14,16, and a neck portion 18. Dispensing ports 26,28, defined within an end face 21 of the neck portion 18, are fluidically connected to the chambers or compartments 14,16 through means of fluid passageways 17, 19, and it is seen that the chambers or compartments 14,16, as well as the fluid passageways 17,19, are separated by means of a web 15. The upstream region 22 of the neck portion 18 is externally threaded as at 24 so as to be threadedly engaged by means of an internally threaded portion 54 of an adjusting nut member 50, and the downstream region 20 of the neck portion 18 is radially recessed such that an upstream annular wall portion 38 of a dispensing nozzle 36 is radially interposed between the downstream region 20 of the neck portion 18 and the nut member 50. The nut member 50 also comprises an annular lip portion 52 for retaining the dispensing nozzle 36 seated upon the neck portion 18.

An outer peripheral portion of the downstream region 20 of the neck portion 18 has an annular groove 32 defined therein for housing an 0-ring seal member 30, and it is seen that the dispensing nozzle 36 also comprises an axially extending dispensing tube 44, within which there is disposed a static mixer 46, and a radially oriented shoulder portion 37. The dispensing tube 44 has an axially extending slot 42 defined therein for accommodating a fluid divider 34 which effectively comprises an integral extension of the web 15 and which effectively prevents rotational movement of the dispensing nozzle 36. Accordingly, it can be appreciated that when the adjusting nut member 50 is fully threaded onto the threaded region 24 of the neck portion 18, internal sealing surfaces 48,49 of the shoulder portion 37 of the dispensing nozzle 36 will effectively block and close off the dispensing ports 26,28 such that dispensing of the adhesive materials are prevented. Conversely, when the adjusting nut member 50 is partially unthreaded with respect to the threaded region 24 of the neck portion 18, the dispensing ports 26,28 will be uncovered and opened so as to permit the adhesive materials to be dispensed.

With reference now being made to FIG. 4, which substantially corresponds to FIG. 4 of the aforenoted patent to Horner et al., a third conventional dual-component adhesive dispensing device is disclosed, and is generally indicated by the reference character 10. More particularly, it is seen that the adhesive dispensing device 10 of Horner et al., in a manner similar to that of the aforenoted devices of Robinson and Ernst, comprises a pair of cylinders 12, 14 for containing two different reactive components of, for example, an epoxy glue compound. The cylinders 12,14 are mechanically joined together by means of a bridge plate 20, and a common dispensing outlet is disclosed at 22. A pair of dispensing conduits or passageways 54,56 are defined within the dispensing outlet 22 and are respectively fluidically connected to the storage cylinders 12,14. The external periphery of the dispensing outlet 22 is provided with threads 36 for threadedly mounting a dispensing nozzle thereon, and a divider wall 55 separates the dispensing conduits or passageways 54,56 so as to ensure that the two reactive components of the compound are in fact maintained separate until the components are dispensed from the dispensing ports 168, 170. A cap 26 comprises a pair of dependent plugs 46,48, and the cap 26 is initially integrally secured upon the upper end portion of the dispensing outlet 22 by means of frangible connections 58 defined between the lower peripheral areas of the plugs 46,48 and the upper end portions of each one of the dispensing conduits or passageways 54,56. A through slot or aperture 52 is defined within an upper region of the cap member 26 so as to accommodate a screwdriver or similar tool by means of which leverage forces can be impressed upon the cap member 26 so as to separate the same from the dispensing outlet 22 as a result of the fracture or rupture of the frangible connections 58 interconnecting the cap member 26 and the dispensing outlet 22. Accordingly, when the cap member 26 has been separated from the dispensing outlet 22, and after a material dispensing operation has been performed, the cap member 26 may be replaced upon the dispensing outlet 22 by inserting the plug members 46,48 respectively within the dispensing ports 168, 170 of the dispensing outlet 22. An abutment flange 50, disposed upon the lower region of the cap member 26, in conjunction with an upwardly projecting divider wall extension 42 which is adapted to be disposed within an interior recess 43 of the cap member 26, limits the extent to which the plug members 46,48 can be respectively inserted into the dispensing ports 168,170 when the cap member 26 is replaced upon the dispensing outlet 22 in order to preserve the viability of the components disposed within the storage cylinders 12,14.

While all of the aforenoted dual-component dispensing devices have been commercially successful, each one of the devices poses or exhibits operational or structural drawbacks or deficiencies wherein it would be desirable to rectify such drawbacks or deficiencies in order to provide a dispensing device which would be simpler and more economical to manufacture, as well as exhibiting enhanced dispensing characteristics. More particularly, it is noted that the dispensing device of Ernst comprises a relatively large number of components which must be manufactured and assembled, while the dispensing devices of Horner et al. and Robinson sometime exhibit difficulties in achieving the proper, clean, and accurate rupture or fracture of the frangible portions integrally interconnecting the cap members to the dispensing outlets or nozzles whereby, in turn, the dispensing outlet ports are in fact fully uncovered and opened. If such operations are not in fact properly achieved, the dispensing of the adhesive mixture components, particularly in the desired percentage proportions, will not always be able to be achieved which can of course adversely affect the resulting chemical composition, and the bonding capabilities, of the adhesive mixture.

A need therefore exists in the art for a new and improved dual-compartment adhesive dispensing device or cartridge which effectively comprises a relatively small number of component parts so as to simplify, and render more economical, the manufacture and assembly of the dispensing device or cartridge, and which effectively incorporates structure integrally connecting the cap member of the cartridge, in a stable manner, to the divider wall of the dispensing cartridge, which separates the two adhesive component compartments from each other, such that when the cap member of the cartridge is separated from the divider wall, and the adhesive mixture component compartments, of the dispensing cartridge, the fracture or rupture of the frangible sections interconnecting the cap member to the divider wall will facilitate a clean and accurate separation of the cap member from the divider wall such that the dispensing ports of the dual-compartment adhesive dispensing cartridge will be fully uncovered and opened.

OBJECTS OF THE INVENTION

Accordingly, it is an object of the present invention to provide a new and improved dual-compartment adhesive dispensing cartridge.

Another object of the present invention is to provide a new and improved dual-compartment adhesive dispensing cartridge which effectively overcomes the various structural and operational disadvantages, drawbacks, and deficiencies characteristic of conventional PRIOR ART dual-compartment adhesive dispensing cartridge.

An additional object of the present invention is to provide a new and improved dual-compartment adhesive dispensing cartridge which comprises a relatively reduced number of component parts so as to substantially simplify manufacture and assembly of the dispensing cartridge as well as to render the manufacture and assembly of the dispensing cartridge substantially more economical and cost-effective.

A further object of the present invention is to provide a new and improved dual-compartment adhesive dispensing cartridge which comprises new and improved structure incorporated within the cap member of the dual-compartment adhesive dispensing cartridge assembly whereby enhanced stability is provided for the cap member with respect to its integral formation and attachment upon the dispensing outlet dual-compartment adhesive dispensing cartridge.

A last object of the present invention is to provide a new and improved dual-compartment adhesive dispensing cartridge which comprises new and improved structure incorporated within the cap member of the dual-compartment adhesive dispensing cartridge assembly whereby enhanced stability is provided for the cap member with respect to its integral formation and attachment upon the dispensing outlet dual-compartment adhesive dispensing cartridge so as to achieve the proper fracture or rupture of the frangible connections defined between the cap member and the dispensing ports of the dispensing cartridge so as to, in turn, ensure the accurate uncovering and opening of the dispensing ports of the dispensing cartridge.

SUMMARY OF THE INVENTION

The foregoing and other objectives are achieved in accordance with the teachings and principles of the present invention through the provision of a new and improved dual-compartment adhesive dispensing cartridge which comprises a pair of cylinders or storage compartments, disposed in a side-by-side spaced relationship with respect to each other, for containing two different reactive components of, for example, an adhesive mixture. A common dispensing outlet portion extends axially upwardly or forwardly, as considered in the downstream dispensing direction, from the pair of cylinders or storage compartments, and a pair of dispensing conduits or passageways, respectively fluidically connected to interior portions of the cylinders or storage compartments, are defined within the dispensing outlet portion by means of a divider wall. The divider wall extends axially upwardly or forwardly, as considered in the downstream dispensing direction, through the entire axial extent of the dispensing outlet portion so as to define the separate dispensing conduits or passageways and thereby ensure that the two reactive components of the adhesive compound mixture are in fact maintained separate until the adhesive mixture components are to be dispensed from dispensing outlet ports which are defined at the extreme upward or forward, as considered in the downstream dispensing direction, dispensing ends of the dispensing conduits or passageways. Preferably, the dispensing outlet ports have substantially rectangular or elliptical-shaped configurations. The external periphery of the dispensing outlet portion is also provided with threads for threadedly mounting a dispensing nozzle thereon.

A cap comprises a pair of dependent plugs, and the cap is initially integrally secured upon the forward or upper end portion of the dispensing outlet portion by means of peripheral frangible connections which are defined between the lower or rearward peripheral areas of the plugs and the forward or upper peripheral end portions, of each one of the dispensing conduits or passageways, which define the dispensing outlet ports. In addition, an axially oriented fin or web member extends upwardly or forwardly from a central region of the dispensing outlet portion, and the cap member is integrally secured directly to the upper extremity of the fin or web member by means of a frangible connection. In this manner, when the cap member is to be separated from the dispensing outlet portion of the adhesive dispensing cartridge, the integral connection defined between the cap member and the fin or web member will effectively serve as a pivotal fulcrum about which the cap member can be moved or pivoted. Such movement of the cap member will cause the clean and accurate fracture or rupture of the frangible connections defined between the plugs of the cap member and the dispensing conduits or passageways of the dispensing outlet portion of the adhesive dispensing cartridge so as to, in turn, cleanly and fully uncover and open the dispensing outlet ports defined within the dispensing outlet portion of the adhesive dispensing cartridge.

In addition to the aforenoted cap structure, a through slot or aperture is defined within an upper region of the cap member so as to accommodate a screwdriver blade or similar tool by means of which leverage forces can be impressed upon or applied to the cap member so as to separate the same from the dispensing outlet portion of the adhesive dispensing cartridge as a result of the aforenoted fracture or rupture of the frangible connections interconnecting the plugs of the cap member and the dispensing conduits or passageways of the dispensing outlet portion. Still further, flange portions are also integrally formed upon external portions of the cap member so as to additionally provide auxiliary means for impressing or applying other twisting, prying, or leverage forces upon the cap member so as to likewise facilitate the separation of the same from the dispensing conduits or passageways of the dispensing outlet portion of the adhesive dispensing cartridge.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
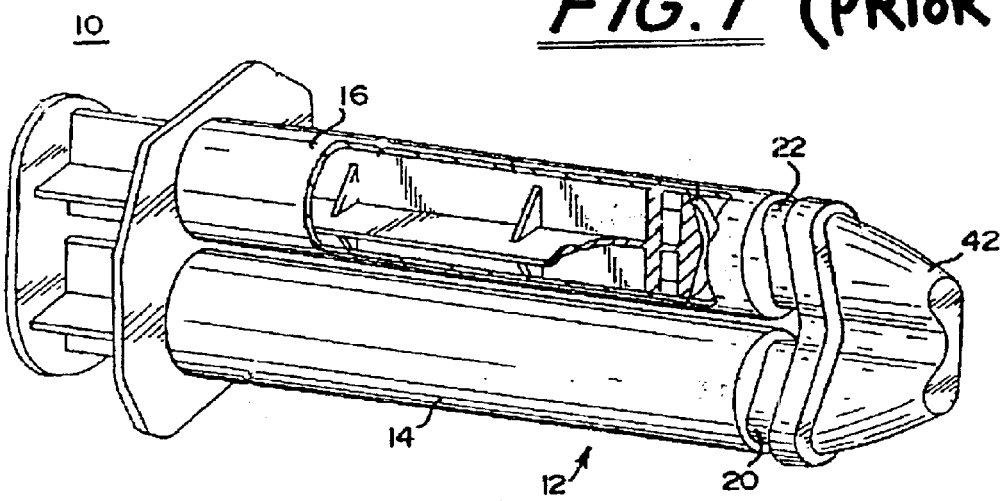
FIG. 1 (PRIOR ART)
FIG. 1 is a perspective view of a first conventional PRIOR ART dual-compartment adhesive dispensing cartridge showing a cap member frangibly connected to the dispensing end portion of the cartridge.
Figure 2:
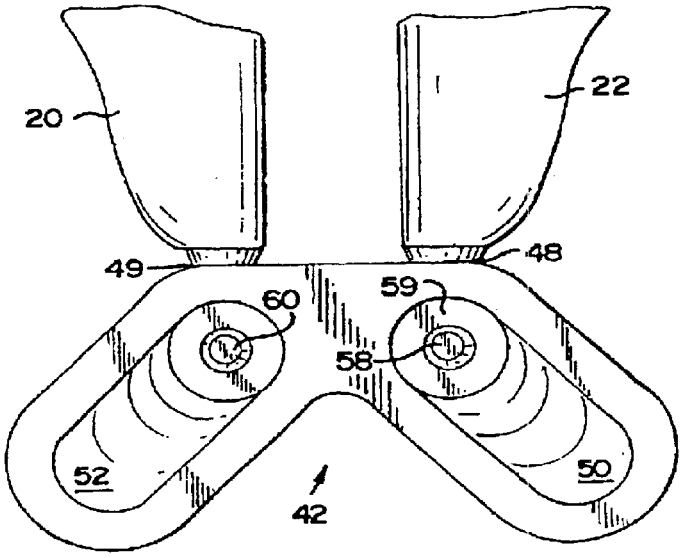
FIG. 2 (PRIOR ART)
FIG. 2 is a partial front view of the first conventional PRIOR ART dual-compartment adhesive dispensing cartridge as disclosed within FIG. 1 and further illustrating the interior structure of the cap member including the dispensing outlet plug members thereof which are adapted to be inserted into the outlet dispensing ports of the dispensing cartridge once the cap member has been separated from the dispensing cartridge nozzles.
Figure 6:
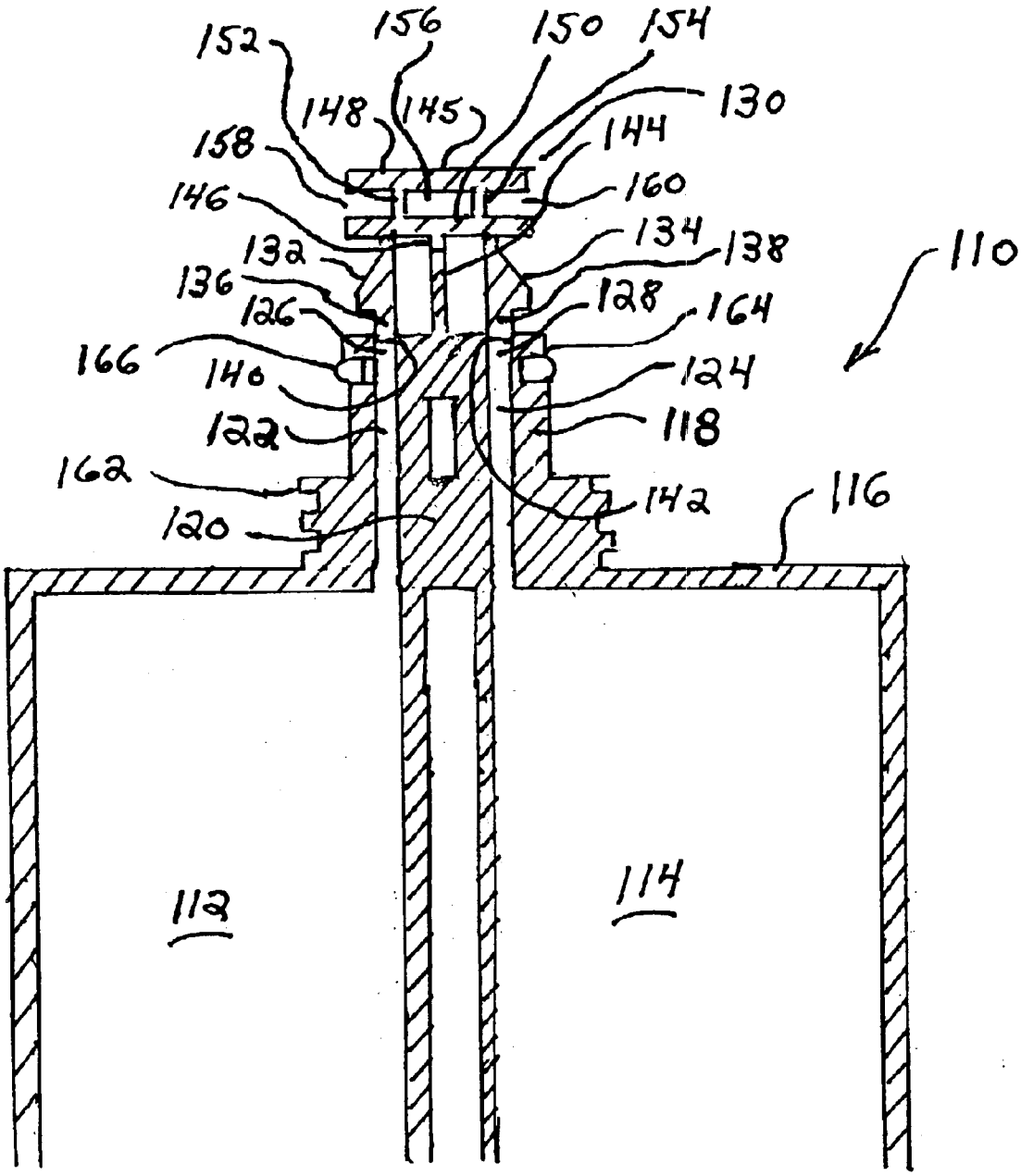
FIG. 6 is a cross-sectional view, corresponding to that of FIG. 5, of the new and improved dual-compartment adhesive dispensing cartridge constructed in accordance with the principles and teachings of the present invention, and also showing the integral attachment of the cap member of the dispensing cartridge to the dispensing outlet portion of the dispensing cartridge by means of the fin or web member.
Figure 1:
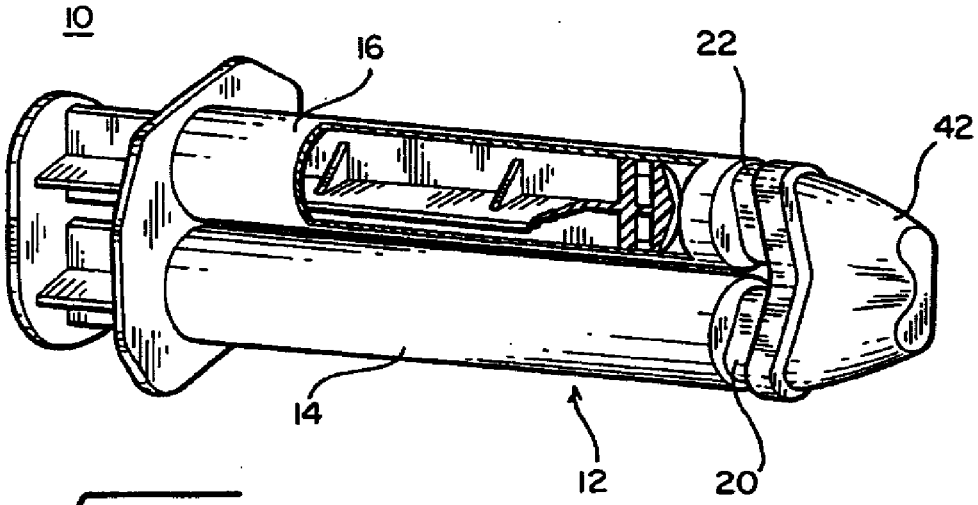
FIG. 1 (PRIOR ART)
Figure 2:
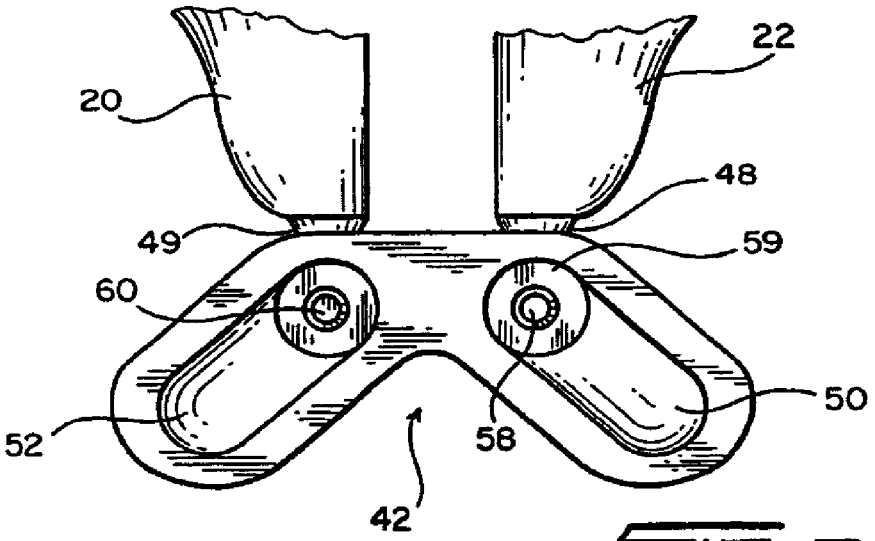
FIG. 2 (PRIOR ART)
Figure 3:
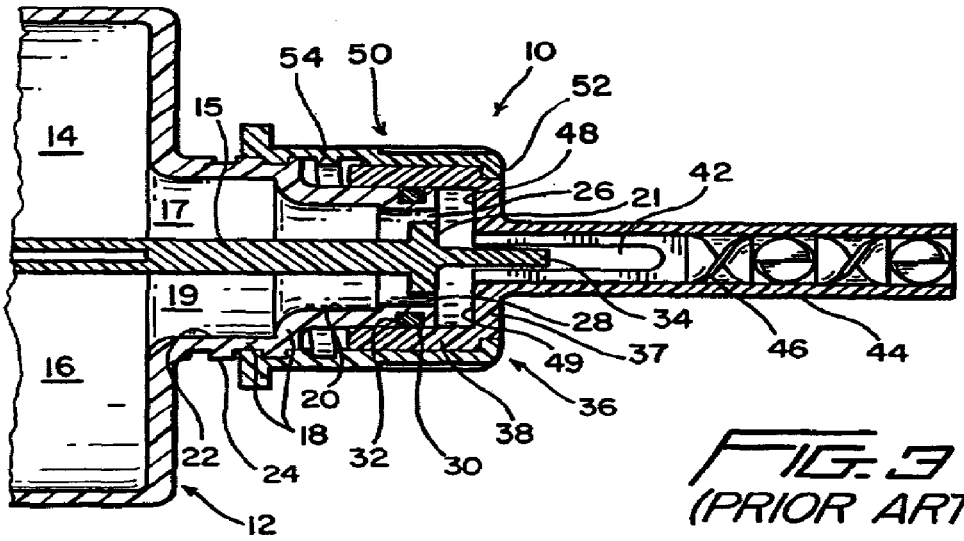
FIG. 3 (PRIOR ART)
FIG. 3 is a cross-sectional view of a second conventional PRIOR ART dual-compartment adhesive dispensing cartridge showing a nozzle member adjustably mounted upon the dispensing end portion of the cartridge.
Figure 5:
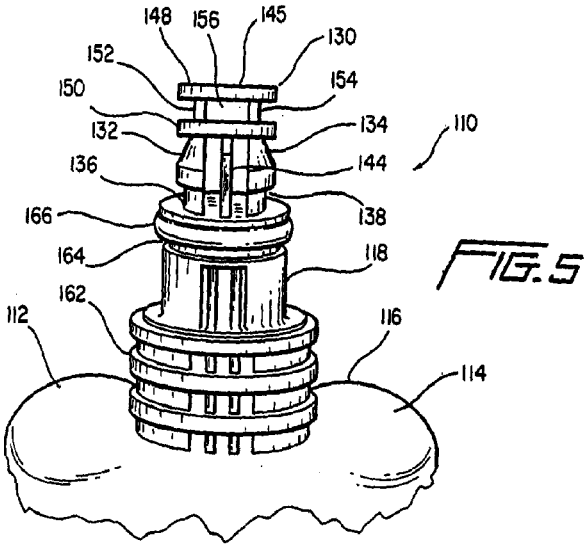
FIG. 5 is a front elevational view of a new and improved dual-compartment adhesive dispensing cartridge constructed in accordance with the principles and teachings of the present invention and showing the cooperative parts thereof, particularly the attachment of the cap member of the dispensing cartridge to the dispensing outlet portion of the dispensing cartridge by means of an integral fin or web member.
Figure 7:
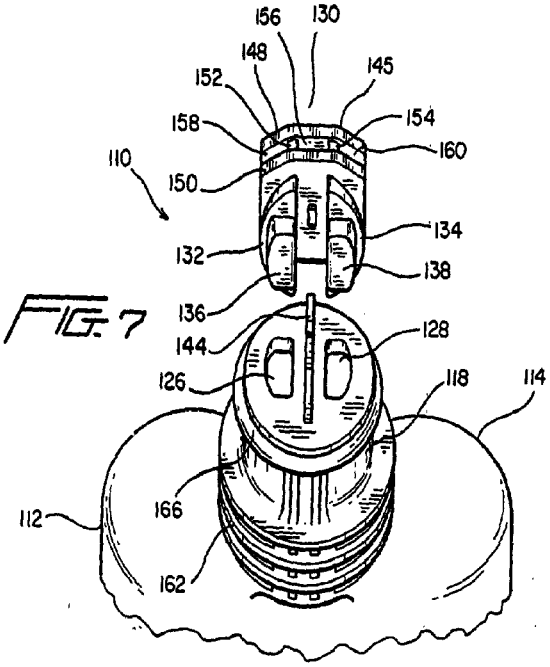
FIG. 7 is a perspective view, corresponding to those of FIGS. 5 and 6, of the new and improved dual-compartment adhesive dispensing cartridge constructed in accordance with the principles and teachings of the present invention, and showing the structure of the cap member of the dispensing cartridge after the cap member has been separated from the fin or web member of the dispensing cartridge and after the frangible connections, defined between the plug members and the dispensing outlet ports of the dispensing outlet portion of the dispensing cartridge, have also been fractured or ruptured.
Figure 6:
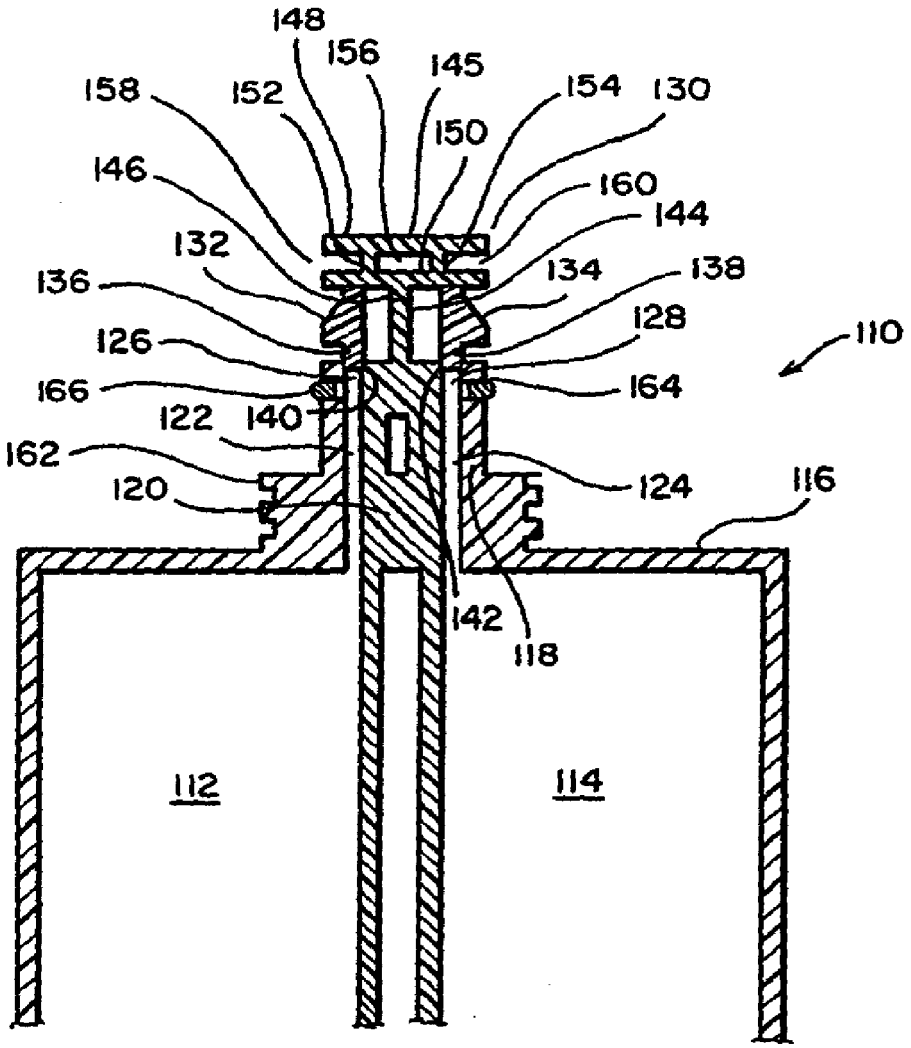

Referring now to the drawings, and more particularly to FIGS. 5–7 thereof, there is disclosed a new and improved dual-compartment adhesive dispensing cartridge, which has been constructed in accordance with the principles and teachings of the present invention, and which is generally indicated by the reference character 110. More particularly, the new and improved dual-compartment adhesive dispensing cartridge 110 is seen to comprise a pair of cylindrical containers or storage compartments 112,114 which are respectively adapted to contain or store individual reactive components of a dual-component adhesive mixture, and which are disposed in a laterally spaced, side-by-side disposition or orientation with respect to each other. The lower or rear end portions of the cylindrical containers or storage compartments 112,114 are integrally connected together by means of a bridge member, not shown, so as to effectively stabilize the lower or rear structure of the dispensing cartridge 110, and the upper or forward end portions of the cylindrical containers or storage compartments 112,114 are integrally connected together by means of a common face plate 116 which therefore closes off the upper or forward end portions of the cylindrical containers or storage compartments 112, 114 as well as stablizes the upper or forward structure of the dispensing cartridge 110. A cylindrical dispensing outlet portion 118 is integrally formed upon the face plate 116 so as to project or extend axially upwardly or forwardly from the same, and an axially extending divider wall 120 is integrally incorporated within the cylindrical dispensing outlet portion 118 at the radially central region thereof.

It is seen that the axially extending divider wall 120 extends through the entire axial extent of the cylindrical dispensing outlet portion 118, and in this manner, the axially extending divider wall 120 effectively cooperates with the radially outer regions of the cylindrical dispensing outlet portion 118 so as to define therewith a pair of axially extending adhesive dispensing outlet passageways or conduits 122,124 which are respectively fluidically connected to the cylindrical containers or storage compartments 112,114 at their lower or rear end portions, while their upper or forward end portions terminate in adhesive dispensing outlet ports 126,128 which have substantially rectangular or elliptical configurations as best seen in FIG. 7. It is therefore to be appreciated that the axially extending divider wall 120 effectively prevents cross-contamination between the adhesive mixture constituents or components separately contained or stored within the respective cylindrical containers or storage compartments 112,114 until the adhesive mixture constituents or components are in fact to be dispensed from the dispensing outlet ports 126,128. It is noted that while the dual-compartment adhesive dispensing cartridge 110 comprises a plurality of different structural components, the dispensing cartridge 110 is effectively formed as a one-piece structure from a suitable thermoplastic material through means of a suitable injection molding process.

Figure 4:
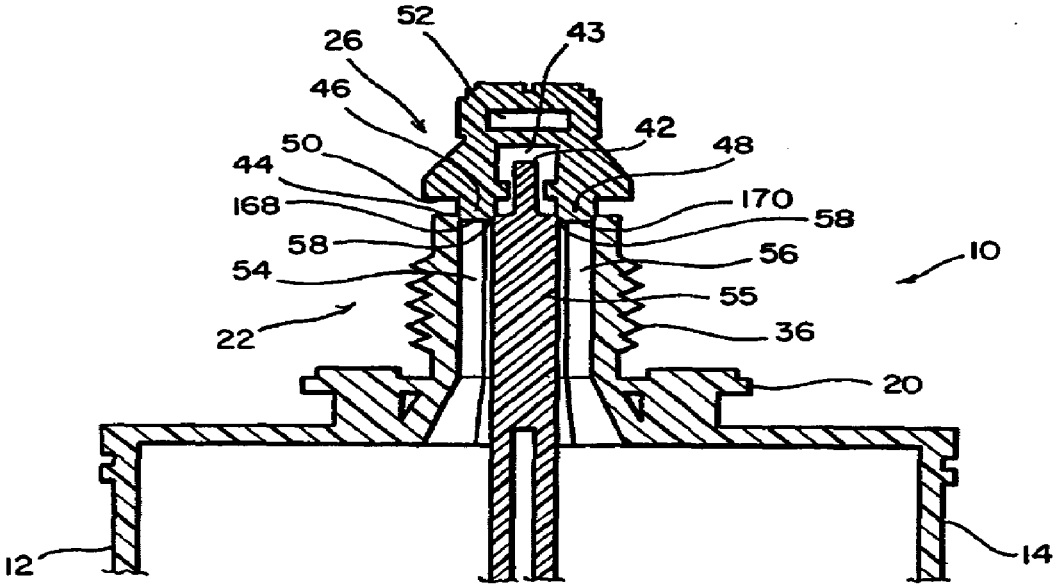
FIG. 4 (PRIOR ART)
FIG. 4 is a cross-sectional view of a third conventional PRIOR ART dual-compartment adhesive dispensing cartridge showing a cap member frangibly connected to the dispensing end portion of the cartridge.

With reference continuing to be made to FIGS. 5–8, and in accordance with one of the primary unique structural features characteristic of the present invention, a cap member 130 is integrally formed upon the upper or forward end portion of the dispensing outlet portion 118. The cap member 130 is seen to comprise a pair of downwardly dependent or rearwardly extending, laterally or transversely spaced leg members 132,134, each one of which has a substantially semi-cylindrical cross-sectional configuration, and it is further appreciated that the leg members 132,134 respectively comprise a downwardly dependent or rearwardly extending plug member 136,138. The lowermost or rearmost region of each plug member 136,138 is adapted to be disposed within the dispensing outlet passageways or conduits 122,124 so as to effectively close off or seal the dispensing outlet ports 126,128, and it is further appreciated that as a result of the fabrication of the dispensing cartridge 110 in accordance with the afornoted injection molding process and as a one-piece structure, the plug members 136,138 are respectively integrally connected to the dispensing outlet portion 118, at the loci of the dispensing outlet ports 126, 128, by means of annular frangible connections 140,142 which may be somewhat structurally similar to the annular frangible connections 58 as disclosed in connection with the dispensing cartridge of Horner et al. as has been illustrated within FIG. 4.

Continuing further, however, and contrary to the structural arrangement characteristic of the attachment of the cap member of Horner et al. to the dispensing outlet portion of the dispensing cartridge, it is to be appreciated that the cap member 130 of the dual-compartment adhesive dispensing cartridge 110 of the present invention, in addition to being integrally connected to the dispensing outlet portion 118 by means of the downwardly dependent or rearwardly extending leg members 132,134, is also integrally connected to the upper or forwardly disposed end surface portion of the dispensing outlet portion 118 by means of a centrally located, upstanding or forwardly extending fin or web member 144. The fin or web member 144 comprises, in effect, a plate member which has a substantially trapezoidal configuration, not shown, whereby the larger, lower base portion of the trapezoidal fin or web member 144 is integrally connected to the upper or forwardly disposed end surface portion of the dispensing outlet portion 118, while the smaller, upper portion of the trapezoidal fin or web member 144 is adapted to be integrally connected to a head section 145 of the cap member 130 by means of a narrow tab member 146. In this manner, the tab member 146 not only effectively defines a frangible connection between the upstanding fin or web member 144 and the cap member 130, but in addition, likewise defines a pivot point or fulcrum about which the cap member 130 can be moved in a side-to-side pivotal mode. As a result of such side-to-side pivotal movement of the cap member 130, with respect to the dispensing outlet portion 118 and around the pivotal or fulcrum point defined by means of the tab member 146, substantially uniform, concentrated forces can be applied in opposite alternative modes, that is, either in tension or compression, to the plug members 136,138 so as to cause substantially precisely defined rupture or fracture of the annular frangible connections 140, 142 defined between the plug members 136,138 and the dispensing outlet ports 126,128.

Accordingly, when the cap member 130 is therefore removed from the dispensing outlet portion 118, as a result of the additional fracture or rupture of the frangible connection, between the cap member 130 and the web or fin member 144, as defined by means of the tab member 146, the dispensing outlet ports 126,128, as best seen in FIG. 7, are completely opened and uncovered so as to permit subsequent dispensing of the adhesive material components from the storage compartments or containers 112,114. It is noted that to substantially ensure the fracture or rupture of the annular frangible connections 140,142, as defined between the plug members 126,128 and the dispensing outlet portion 118, before the fracture or rupture of the frangible connection between the cap member 130 and the web or fin member 144, as defined by means of the tab 146, the thickness dimensions of such frangible connections can of course be suitably or optimally controlled. Still further, after the cap member 130 has been separated from the adhesive dispensing cartridge 110, as illustrated in FIG. 7, it is additionally noted that the cap member 130 is not intended to be, nor can it physically be, re-mounted upon the adhesive dispensing cartridge 110. The reason for this is that, in view of the interdisposition of the upstanding web or fin member 144 between the dispensing outlet portion 118 and the undersurface portion of the head section 145 of the cap member 130, the plug members 136,138 are effectively prevented from being inserted into the upper regions of the dispensing outlet passageways or conduits 122,124 in such a manner as to in fact properly and tightly close and seal the dispensing outlet ports 126,128. Accordingly, the adhesive dispensing cartridge 110 of the present invention is substantially designed as a single, or one-time, use type adhesive dispensing cartridge, that is, for example, for use in connection with the dispensing of the adhesive material within a relatively short period of time, as opposed to the use of the same over a substantially extended period of time during which the adhesive material components or constituents can in fact be viably stored within the containers or storage compartments 112,114 as a result of the re-mounting of the cap member upon the dispensing cartridge.

With reference still being made to FIGS. 5–7, several other features, characteristic of the present invention, are likewise to be additionally appreciated. For example, the head section 145 of the cap member 130 is seen to comprise a pair of transversely or horizontally oriented parallel head plate members 148,150, which, as can best be seen from FIG. 7, have a substantially octagonal configuration, and the head plate members 148,150 are maintained vertically spaced from each other by means of a pair of vertically oriented, parallel spacer plates 152,154. Accordingly, a central slot or through-aperture 156 is defined within the head section 145 of the cap member 130 for receiving the blade of a suitable tool, such as, for example, a screwdriver, knife, or the like, by means of which the aforenoted twisting or pivotal forces can be applied to or impressed upon the cap member 130 in order to achieve the rupture or fracture of the frangible members 140,142,146 in order to achieve the desired separation of the cap member 130 from the dispensing outlet portion 118 of the adhesive dispensing cartridge 110. In addition, it is noted that the laterally or radially outwardmost portions of the head plates 148,150 project laterally or radially beyond the locations at which the vertically oriented spacer plates 152, 154 are located, and in this manner, such laterally or radially outwardmost portions of the head plates 148,150 serve as flanged portions so as to effectively define diametrically opposite, laterally open recesses 158,160 within which, for example, the end portions of a suitable prying tool, not shown, may be disposed whereby the aforenoted twisting or leverage forces can likewise be applied to or impressed upon the cap member 130 in order to achieve the rupture or fracture of the frangible members 140,142,146 so as to achieve the desired separation of the cap member 130 from the dispensing outlet portion 118 of the adhesive dispensing cartridge 110.

As a last feature of the adhesive dispensing cartridge 110 of the present invention, it is noted that the lowermost or rearwardmost section of the dispensing outlet portion 118 is provided with external threads 162 by means of which a suitable adhesive material dispensing nozzle, not shown, may be threadedly secured thereon. In conjunction with such threaded structure 162, and in order to properly operatively engage the dispensing nozzle, not shown, in a sealed manner, the upper or forward end section of the dispensing outlet portion 118 is provided with an annular recess 164 within which a suitable O-ring sealing member 166 is adapted to be fixedly disposed.

Thus, it may be seen that in accordance with the principles and teachings of the present invention, there has been disclosed a new and improved dual-compartment adhesive dispensing cartridge which comprises a pair of cylinders or storage compartments, disposed in a side-by-side spaced relationship with respect to each other, for containing two different reactive components of, for example, an adhesive mixture, and wherein a common dispensing outlet portion extends axially upwardly or forwardly, as considered in the downstream dispensing direction, from the pair of cylinders or storage compartments. A pair of dispensing conduits or passageways, respectively fluidically connected to interior portions of the cylinders or storage compartments, are defined within the dispensing outlet portion by means of a divider wall which extends axially upwardly or forwardly, as considered in the downstream dispensing direction, through the entire axial extent of the dispensing outlet portion so as to define the separate dispensing conduits or passageways and thereby ensure that the two reactive components of the adhesive compound mixture are in fact maintained separate until the adhesive mixture components are to be dispensed from dispensing outlet ports which are defined at the extreme upward or forward, as considered in the downstream dispensing direction, dispensing ends of the dispensing conduits or passageways. A cap member comprises a pair of dependent plugs, and the cap member is initially integrally secured upon the forward or upper end portion of the dispensing outlet portion by means of peripheral frangible connections which are defined between the lower or rearward peripheral areas of the plugs and the forward or upper peripheral end portions, of each one of the dispensing conduits or passageways, which define the dispensing outlet ports. In addition, an axially oriented fin or web member extends upwardly or forwardly from a central region of the dispensing outlet portion, and the cap member is integrally secured directly to the upper extremity of the fin or web member by means of a frangible connection. In this manner, when the cap member is to be separated from the dispensing outlet portion of the adhesive dispensing cartridge, the integral connection defined between the cap member and the fin or web member will effectively serve as a pivotal fulcrum about which the cap member can be moved or pivoted. Such movement of the cap member will cause the clean and accurate fracture or rupture of the frangible connections defined between the plugs of the cap member and the dispensing conduits or passageways of the dispensing outlet portion of the adhesive dispensing cartridge so as to, in turn, cleanly and fully uncover and open the dispensing outlet ports defined within the dispensing outlet portion of the adhesive dispensing cartridge.

Obviously, many variations and modifications of the present invention are possible in light of the above teachings. It is therefore to be understood that within the scope of the appended claims, the present invention may be practiced otherwise than as specifically described herein.

What is claimed as new and desired to protected by Letters Patent of the United States of America, is:

1. A dual-compartment fluid dispensing cartridge, comprising:

a pair of compartments for respectively containing two reactive components of a fluid to be dispensed;

a dispensing outlet portion integrally connected to said pair of compartments;

a divider wall integrally connected to said pair of compartments and operatively cooperating with said dispensing outlet portion so as to define a pair of fluidically separated dispensing conduits within said dispensing outlet portion for separately conducting the two reactive components toward separated dispensing outlet ports;

a cap member having a pair of plugs disposed thereon for disposition within said separated dispensing outlet ports;

first means for frangibly interconnecting said pair of plugs of said cap member to said dispensing outlet ports; and a web member interposed between said pair of plugs of said cap member and interconnecting said cap member to said divider wall so as to serve as a fulcrum about which said cap member can be pivoted in order to impress alternative tension and compression forces upon said pair of plugs, and said first frangible connections defined between said pair of plugs and said dispensing outlet ports, in order to cause the clean and accurate rupture of said first frangible connections defined between said pair of plugs and said dispensing outlet ports and thereby fully uncover and open said dispensing outlet ports.

2. The fluid dispensing cartridge as set forth in claim 1, wherein:

said fluid dispensing cartridge, comprising said pair of compartments, said dispensing outlet portion, said divider wall, said cap member, and said web member, comprises a one-piece structure.

3. The fluid-dispensing cartridge as set forth in claim 2, wherein:

said one-piece structure comprises an injection molded structure.

4. The fluid-dispensing cartridge as set forth in claim 3, wherein:

said injection-molded structure is fabricated from a suitable thermoplastic material.

5. The fluid-dispensing cartridge as set forth in claim 1, further comprising:

second means for frangibly interconnecting said cap member to said web member.

6. The fluid-dispensing cartridge as set forth in claim 1, wherein:

each one of said dispensing outlet ports has a substantially rectangular configuration.

7. The fluid-dispensing cartridge as set forth in claim 1, wherein:

each one of said dispensing outlet ports has a substantially elliptical configuration.

8. The fluid-dispensing cartridge as set forth in claim 1, wherein:

said cap member has a through-slot defined therein for accommodating the insertion therethrough of a tool by means of which forces can be impressed upon said cap member in order to, in turn, impress said compression and tension forces upon said first means frangibly interconnecting said pair of plugs of said cap member to said dispensing outlet ports.

9. The fluid-dispensing cartridge as set forth in claim 1, wherein:

said cap member comprises a head section comprising a pair of parallel plates spaced from each other so as to define diametrically opposite recesses therebetween and within which a tool can be inserted by means of which forces can be impressed upon said cap member in order to, in turn, impress said compression and tension forces upon said first means frangibly interconnecting said pair of plugs of said cap member to said dispensing outlet ports.

10. The fluid-dispensing cartridge as set forth in claim 1, wherein:

said dispensing outlet portion is provided with external thread means for threadedly receiving a nozzle member through which the fluid to be dispensed can be dispensed.

11. A dual-compartment adhesive dispensing cartridge, comprising:

a pair of compartments for respectively containing two reactive components of an adhesive to be dispensed;

a dispensing outlet portion integrally connected to said pair of compartments;

a divider wall integrally connected to said pair of compartments and operatively cooperating with said dispensing outlet portion so as to define a pair of fluidically separated dispensing conduits within said dispensing outlet portion for separately conducting the two reactive components toward separated dispensing outlet ports;

a cap member having a pair of plugs disposed thereon for disposition within said separated dispensing outlet ports;

first means for frangibly interconnecting said pair of plugs of said cap member to said dispensing outlet ports; and a web member interposed between said pair of plugs of said cap member and interconnecting said cap member to said divider wall so as to serve as a fulcrum about which said cap member can be pivoted in order to impress alternative tension and compression forces upon said pair of plugs, and said first frangible connections defined between said pair of plugs and said dispensing outlet ports, in order to cause the clean and accurate rupture of said first frangible connections defined between said pair of plugs and said dispensing outlet ports and thereby fully uncover and open said dispensing outlet ports.

12. The adhesive dispensing cartridge as set forth in claim 11, wherein:

said adhesive dispensing cartridge, comprising said pair of compartments, said dispensing outlet portion, said divider wall, said cap member, and said web member, comprises a one-piece structure.

13. The adhesive-dispensing cartridge as set forth in claim 12, wherein:

said one-piece structure comprises an injection molded structure.

14. The adhesive-dispensing cartridge as set forth in claim 13, wherein:

said injection-molded structure is fabricated from a suitable thermoplastic material.

15. The adhesive-dispensing cartridge as set forth in claim 11, further comprising:

second means for frangibly interconnecting said cap member to said web member.

16. The adhesive-dispensing cartridge as set forth in claim 11, wherein:

each one of said dispensing outlet ports has a substantially rectangular configuration.

17. The adhesive-dispensing cartridge as set forth in claim 11, wherein:

each one of said dispensing outlet ports has a substantially elliptical configuration.

18. The adhesive-dispensing cartridge as set forth in claim 11, wherein:

said cap member has a through-slot defined therein for accommodating the insertion therethrough of a tool by means of which forces can be impressed upon said cap member in order to, in turn, impress said compression and tension forces upon said first means frangibly interconnecting said pair of plugs of said cap member to said dispensing outlet ports.

19. The adhesive-dispensing cartridge as set forth in claim 11, wherein:

said cap member comprises a head section comprising a pair of parallel plates spaced from each other so as to define diametrically opposite recesses therebetween and within which a tool can be inserted by means of which forces can be impressed upon said cap member in order to, in turn, impress said compression and tension forces upon said first means frangibly interconnecting said pair of plugs of said cap member to said dispensing outlet ports.

20. The adhesive-dispensing cartridge as set forth in claim 11, wherein:

said dispensing outlet portion is provided with external thread means for threadedly receiving a nozzle member through which the adhesive to be dispensed can be dispensed.

* * * * *

UNITED STATES PATENT AND TRADEMARK OFFICE

CERTIFICATE OF CORRECTION

PATENT NO. : 6,874,661 B2
DATED : April 5, 2005
INVENTOR(S) : Mark S. Timmerman et al.

It is certified that error appears in the above-identified patent and that said Letters Patent is hereby corrected as shown below:

Delete the title page and insert therefore the attached title page.

Delete the Drawing Sheets 1-4 and insert therefore the attached Drawing Sheets 1-4.

Signed and Sealed this

Twenty-fourth Day of May, 2005

JON W. DUDAS
*Director of the United States Patent and Trademark Office*

(12) United States Patent
Timmerman et al.

(10) Patent No.: US 6,874,661 B2
(45) Date of Patent: Apr. 5, 2005

(54) STABILIZING CAP FOR DUAL-COMPARTMENT ADHESIVE DISPENSING CARTRIDGE

(75) Inventors: Mark S. Timmerman, Elgin, IL (US); James E. Surjan, St. Charles, IL (US); Richard P. Babrowski, Oak Lawn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 200 days.

(21) Appl. No.: 10/402,633

(22) Filed: Mar. 28, 2003

(65) Prior Publication Data

US 2004/0188465 A1 Sep. 30, 2004

(51) Int. Cl.[7] ..... B67D 5/52; B65D 47/10

(52) U.S. Cl. ..... 222/135; 222/137; 222/145.1; 222/153.03; 222/153.07; 222/386; 222/541.6; 222/541.7; 222/541.9; 215/253

(58) Field of Search ..... 222/135, 137, 222/145.1, 145.5, 153.03, 153.05, 153.06, 153.07, 541.1, 541.5, 541.6, 541.7, 541.9, 386; 215/235, 250, 253

(56) References Cited

U.S. PATENT DOCUMENTS 3,828,980 A * 8/1974 Creighton et al. ..... 222/137
4,355,729 A * 10/1982 Maguire ..... 215/215
4,771,919 A 9/1988 Ernst
5,137,182 A * 8/1992 Keller ..... 222/153.1
5,152,432 A * 10/1992 De Laforcade ..... 222/145.1
5,676,280 A 10/1997 Robinson
6,412,660 B1 * 7/2002 Bouix et al. ..... 222/94
6,484,904 B1 11/2002 Horner et al.
2002/0170926 A1 11/2002 Horner et al.

* cited by examiner

*Primary Examiner*—Gene Mancene
*Assistant Examiner*—Patrixk Buechner
(74) *Attorney, Agent, or Firm*—Lisa M. Soltis; Mark W. Croll; Donald J. Breh

(57) ABSTRACT

A cap member for a dual-compartment adhesive dispensing cartridge comprises a pair of dependent plugs, the cap member is initially integrally secured upon an upper end portion of a dispensing outlet portion by frangible connections which are defined between the plugs and upper end portions of a pair of dispensing conduits that are defined within the dispensing outlet portion by a divider wall. In addition, an axially oriented web member extends upwardly from a central region of the dispensing outlet portion, and the cap member is integrally secured to the upper extremity of the web member by another frangible connection. In this manner, when the cap member is to be separated from the dispensing cartridge, the integral connection defined between the cap member and the web member effectively serves as a pivotal fulcrum about which the cap member can be pivoted.

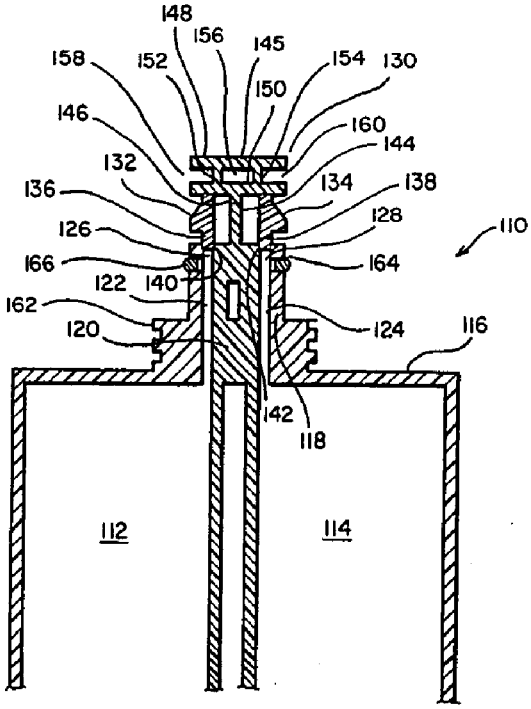

20 Claims, 4 Drawing Sheets